United States Patent [19]

Dayne

[11] Patent Number: 4,471,645

[45] Date of Patent: Sep. 18, 1984

[54] SHANK SHAPER

[76] Inventor: Frank Dayne, 8 Pleasentview Bay, Regina, Saskatchewan, Canada, S4R 5H3

[21] Appl. No.: 410,872

[22] Filed: Aug. 24, 1982

[30] Foreign Application Priority Data

Feb. 16, 1982 [CA] Canada ..... 396321

[51] Int. Cl.[3] ..... B21D 5/00; B21D 37/04; B21J 13/00

[52] U.S. Cl. ..... 72/457; 72/293; 72/302; 72/390; 72/306; 72/481

[58] Field of Search ..... 72/306, 296, 297, 293, 72/301, 302, 311, 386, 457, 481, 390

[56] References Cited

U.S. PATENT DOCUMENTS

| | | | |
|---|---|---|---|
| 187,957 | 3/1877 | Baldwin | 72/302 |
| 437,702 | 10/1890 | Loomis | 72/302 |
| 1,819,311 | 8/1931 | Wochner | 72/386 |
| 2,431,173 | 11/1947 | Hawkes | 72/297 |
| 2,437,092 | 3/1948 | Greene, Jr. et al. | 72/296 |
| 2,736,359 | 2/1956 | Bowman | 72/302 |
| 3,059,686 | 10/1962 | Franck | 72/317 |
| 3,292,410 | 12/1966 | Baldassano | 72/297 |
| 3,429,169 | 2/1969 | Boice et al. | 72/297 |
| 3,518,864 | 7/1970 | Pietronuto et al. | 72/302 |
| 4,238,951 | 12/1980 | Grainger et al. | 72/457 |

FOREIGN PATENT DOCUMENTS 597227 5/1934 Fed. Rep. of Germany ..... 72/297

*Primary Examiner*—Daniel C. Crane
*Attorney, Agent, or Firm*—Stanley G. Ade

[57] ABSTRACT

Arcuately curved cultivator shanks carrying ground working tools often become partially straightened or the attaching portion becomes bent due to the ground working tool engaging obstructions such as a root, rock or the like. Due to the resiliency thereof, they are difficult to re-shape to the original contours or specifications. The present device includes firstly, a vertical standard having a cross pin at the upper end thereof under which the hooked attaching end may be engaged. The distal end, which is apertured to receive the ground working tool, is engaged by a jack underneath the standard and a sliding member engages within the standard and is engaged by the distal end of the shank so that when the jack is extended, the arcuately curved portion is re-shaped to the original contours. Secondly, the attaching portion of the shank which may have become distorted or bent due to the shaping of the arcuately curved portion, may be engaged between a pair of spaced apart horizontally situated cross pins between a pair of horizontal members. The jack is then engaged with the attaching portion between the cross pins and is extended thereby straightening the attaching portion.

4 Claims, 6 Drawing Figures

SHANK SHAPER

BACKGROUND OF THE INVENTION

This invention relates to new and useful improvements in re-shaping or straightening ground working tool carrying shanks. Such shanks usually include a substantially horizontal attaching portion by which they are attached to the implement and extend in an arcuately curved major portion to a distal end upon which ground working tools such as cultivator shovels, points or the like may be secured.

The shanks are resilient so that under normal circumstances, they may move rearwardly to clear hard ground portions, small rocks, roots and the like. However, if a relatively large or difficult obstruction is engaged by the ground working tool, the shanks are often displaced beyond the elastic limit of the resilient material and therefore do not return to the original contours. Such displacement may take place either in the arcuately curved major portion or in the attaching portion, depending upon circumstances.

Conventionally, these are straighted or re-shaped by hammering or occasionally, by the application of heat which destroys the original temper or resiliency so that the shanks have to be re-tempered, all of which is time consuming and relatively expensive.

SUMMARY OF THE INVENTION

The present invention overcomes these disadvantages by providing a shank shaping device normally termed a shank straightener, which permits the major arcuately curved portion of the shank to be displaced beyond the elastic limit thereof so that the arcuately curved portion can be returned to its original contour. Sometimes this results in the straight attaching portion being bent or displaced and sometimes this portion is displaced or bent due to the engagement with the aforementioned obstruction. In either event, means are provided on the device to permit this straight attaching portion to be straightened or to be returned to its original position.

The source of power for the shaping or straightening of such a shank is by means of a conventional mechanical or hydraulic jack which may be used in association with the invention as will hereinafter be described.

In accordance with the invention there is therefore provided a shaper for arcuately curved, resilient tool carrying shanks which include a substantially straight attaching portion having a hooked or angulated end and an arcuately curved major portion adapted to receive a ground working tool on the distal apertured end thereof; said shaper comprising in combination supporting structure, said supporting structure including a base portion, a standard, standard support struts supporting said standard above said base portion of said supporting structure, means adjacent the upper end of said standard to detachably receive the hooked attaching end of a shank to be shaped, a jack supportable upon the base portion of said supporting structure, under said standard and a sliding member, means in the lower end portion of said standard for receiving said sliding member within said lower end for reciprocal motion therein, the lower end of said sliding member engaging the distal end of said shank being shaped, said jack operatively engaging said distal end of said shank to move same with said sliding member, upwardly within said standard thereby bowing said shank beyond the elastic limit thereof, to reshape same.

Another advantage of the invention is that it can be used to re-shape the curved portion and, if necessary, also to re-shape or straighten the attaching portion of a resilient shank.

Another advantage of the invention is to provide a device which includes means to detachably receive the shank therein in such a way that it cannot inadvertently become displaced from the shaper during the relatively heavy stresses involved, in bending or curving the shank beyond its elastic limit in order to re-shape same, it being understood that such displacement can be extremely dangerous due to the excessive pressures required.

A still further advantage of the invention is to provide a device of the character herewithin described which is readily portable so that it can be used in the field if desired, it being understood that a conventional relatively heavy duty jack is all that is required for the source of power.

Still another advantage of the invention is that the sliding member is reversible within the standard so that it is adapted to engage the tool attaching apertures of various sizes.

A still further advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in different figures.

DETAILED DESCRIPTION

Figure 1:
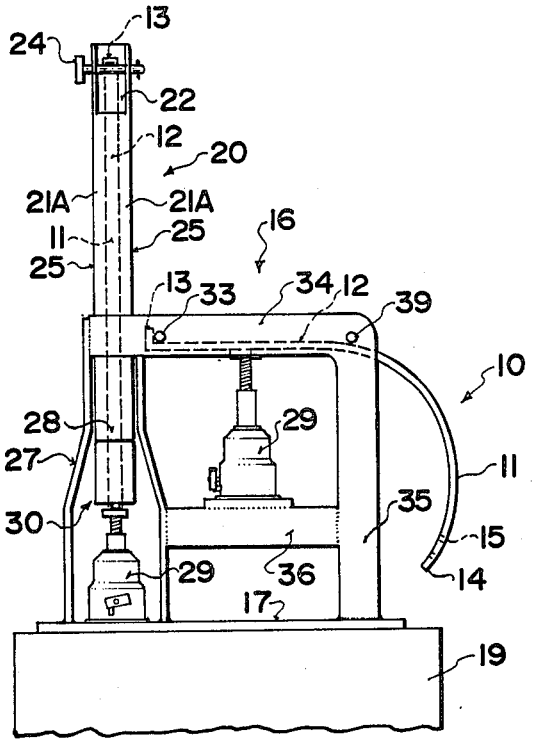
FIG. 1 is a side elevation of the device showing a shank in full line engaged within the device.
Figure 2:
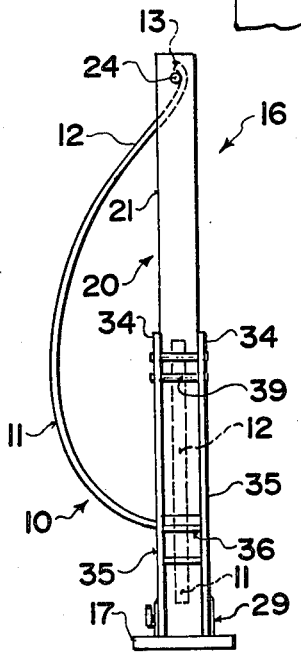
FIG. 2 is a side elevation of FIG. 1.
Figure 3:
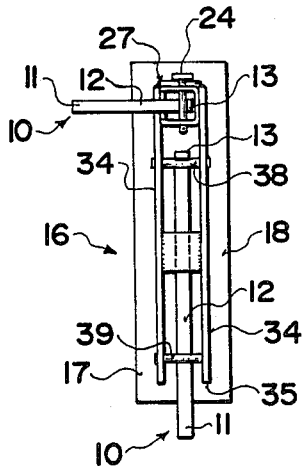
FIG. 3 is a top plan view of FIG. 1.

Proceeding therefore to describe the invention in detail, reference should first be made to FIGS. 1, 2 and 3 and in this connection, a conventional shank is shown collectively designated 10 including the arcuately curved major portion 11 extending from the relatively straight or horizontal portion 12 which terminates in a hooked end 13. The distal end 14 of the major portion 11 is provided with one or more apertures 15 for detachable securement of a ground working tool (not illustrated) such as a cultivator shovel, point, or the like.

In FIG. 1, the shank is shown in full line in a position for straightening or re-shaping the attaching portion 12 and in phantom engaged for re-shaping the major arcuately curved portion 11.

In FIG. 2, these positions are reversed with the shank being shown in full line for re-shaping the arcuately curved portion 11 and in phantom for straightening or re-shaping the attaching portion 12.

In FIG. 3, the shank is shown in full line in both instances although it should be understood that the shank can only be straightened in one position or the other at one time.

The shaper collectively designated 16 includes supporting structure comprising base supporting structure 17 which preferably takes the form of a substantially rectangular plate or similar structure 18 which may be supported upon a stand 19, if desired.

A standard is provided collectively designated 20 and in the preferred embodiment, this standard takes the form of a square cross sectioned length of hollowed tubing 21 having a portion 22 cut away adjacent the upper end thereof and on one side face 23. A cross pin 24 engages apertures within the other side faces or plates 25 adjacent the upper end of the standard 20, said cross pin spanning the apertured portion 22 and being detachably secured by means of a cotter pin 26 or the equivalent.

Further standard supporting structure is provided and, in this embodiment, consists of a pair of curved, substantially vertically situated supporting members 27, secured as by welding or the like by the lower ends thereof to the base supporting structure 17 and by the upper ends thereof to the side faces 25 of the standard so that the lower end 28 of the standard is situated spaced above the base supporting structure 17 with the standard extending vertically thereabove. The standard supporting struts 27 are curved to provide clearance adjacent the lower ends thereof in order to receive a conventional hydraulic or mechanical jack 29 which in turn is supported upon the base supporting structure 17.

Figure 4:
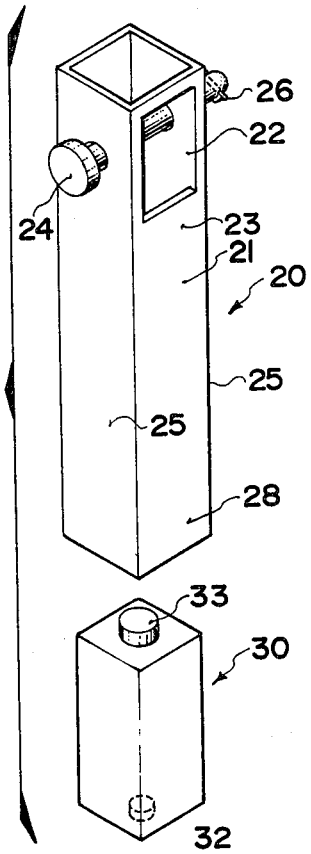
FIG. 4 is an enlarged exploded view of the standard and sliding member.
Figure 6:
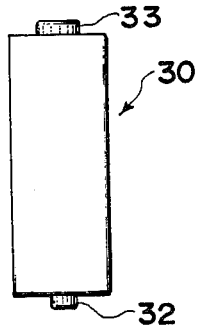
FIG. 6 is an enlarged side elevation of the sliding member per se.
Figure 5:
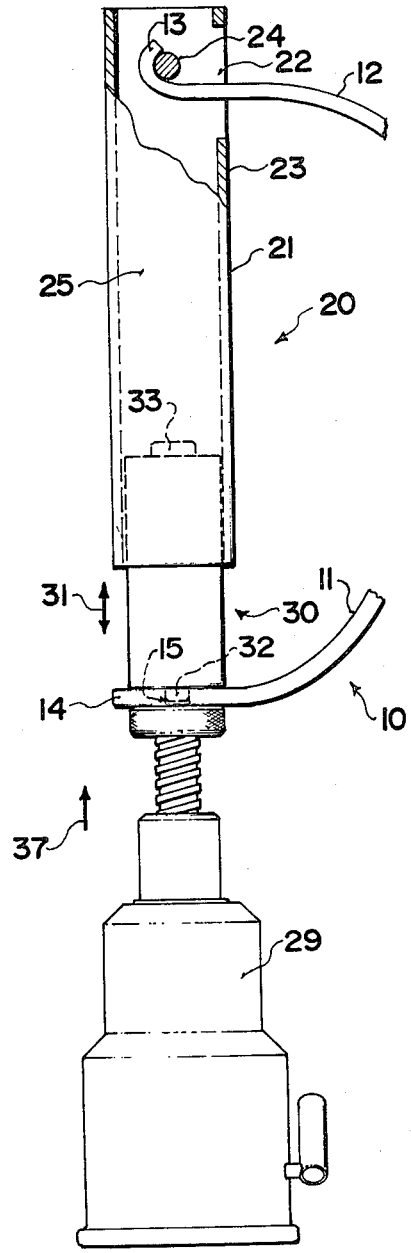
FIG. 5 is a partially fragmented view of the standard, sliding member and jack enlarged with respect to FIGS. 1, 2 and 3.

Reference to FIGS. 4 and 5 will show a slider member collectively designated 30. This member is provided with a cross section similar to the interior cross section of the standard 20 and is slidable vertically within the lower end portion of the standard as shown in FIG. 5 and indicated by means of double headed arrow 31.

It is provided with a pin or projection 32 upon the lower end thereof which is freely engageable within one of the aforementioned apertures 15 formed through the distal end 14 of the arcuately curved major portion 11 of the shank 10 as clearly shown in FIG. 5. Preferably, the slider member 30 is reversible and is provided with a further pin or projection 33 upon the opposite end thereof, having a diameter different from the projection or pin 32 so that it can be used in shanks having apertures 15 of different dimensions in order that a relatively snug fit may be obtained between the pin and the aperture 15 in the shank. A pair of spaced and parallel horizontally situated members 34 are provided secured by one end of each thereof to opposite side faces 21 and 21A of the standard, such securement being as by welding or the like. It is preferable that these engage the standard adjacent the upper ends of the aforementioned standard struts 27 so that a firm support is provided to the standard.

Vertical struts 35 extend downardly from the other ends of the members 34 and these vertical struts engage the base structure 17 as clearly shown in FIG. 1.

Horizontal supports or struts 36 extend between one of the standard struts 27 and the vertical struts or members 35 spaced and parallel to the base structure 17 and this vertical support structure 36 acts as a support for the aforementioned jack 29 when the device is being used to straighten the attaching portion 12 of the shank.

In operation, it is usual that the arcuately curved major portion 11 of the shank is distorted beyond the elastic limit thereof thus resulting in this major portion being partially straightened.

In order to return it to the original contour, the hooked end 13 is first engaged under the cross pin 24 at the upper end of the standard with the distal apertured end 14 being engaged over the pin or projection 32 or 33 of the slider member 30 which in turn is engaged within the lower end of the standard. The jack 29 is then engaged with the lower end of the slider member, it being appreciated that the pin is short enough so that it does not extend beyond the thickness of the shank. The jack is then actuated or extended in the direction of arrow 37 thus moving the slider member 30 upwardly within the standard and decreasing the arcuate curvature of the major portion 11 of the shank. The jack is actuated until the elastic limit of the arcuate portion is exceeded so that the shank can be re-shaped by continuing pressure until the original contour is returned to the shank whereupon the jack is released and the shank is removed. When undertaking such action, the straight or attaching portion 12 may be distorted or bent. Occasionally, such distortion or bending may take place due to the engagement of the shank with the aforementioned obstruction.

Under these circumstances, it is necessary to use the other portion of the shaping device which includes the horizontal members 34 and the horizontal support structure 36. The hooked end 13 of the shank is engaged over a cross pin 38 spanning the members 34 adjacent the attachment thereof to the standard. A further cross pin 39 also spans the members 34 adjacent the distal ends thereof and the shank is engaged under this pin as clearly shown in FIG. 1.

The aforementioned jack 29 is placed upon the horizontal supporting structure 36 and engages the attaching portion 12 of the shank intermediate the pins 38 and 39 so that extension of the jack will straighten the shank and return it to its original contour.

It will therefore be appreciated that a simple straightening and/or re-shaping device is provided for resilient shanks which is easily actuated by means of a conventional heavy duty mechanical or hydraulic jack and which furthermore includes means to retain the shank safely in position while the excessive pressures are imposed thereon thus removing any danger of inadvertent displacement.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A shaper for arcuately curved, resilient tool carrying shanks which include a substantially straight attaching portion having a hooked or angulated end and an arcuately curved major portion adapted to receive a ground working tool on the distal apertured end thereof; said shaper comprising in combination supporting structure, said support structure including a base portion, a standard having a longitudinal axis including an upper end and a lower end, means supporting said standard above said base portion of said supporting structure, means ajacent the upper end of said standard to detachably received the hooked attaching end of a shank to be shaped, a jack supportable upon the base portion of said supporting structure, under said standard, and a sliding member including a lower end, means in the lower end of said standard for receiving said sliding member within said lower end for reciprocal motion therein, said sliding member sliding along said longitudinal axis of said standard, the lower end of said sliding member engaging the distal end of said shamk being shaped, said jack operatively engaging said distal end of said shank to move same with said sliding member along the longitudinal axis of said standard, upwardly within said standard thereby bowing said shank beyond the elastic limit thereof, to reshape same, means to detachably secure said distal end of the shank being shaped, between said jack and the lower end of said sliding member, said means to detachably secure said distal end including a pin including a longitudinal axis, with said longitudinal axis of said pin extending parallel with the longitudinal axis of said standard and extending from said lower end of said sliding member upwardly towards the upper end of said standard and engagable within the aperture in the distal end of the shank being shaped, to prevent displacement of said distal end from between said jack and said sliding member during the shaping process.

2. The shaper according to claim 1 in which said sliding member is reversible within said standard and which includes a pin on either end thereof, said pins having different diameters to engage apertures of similar diameters in the shank being shaped.

3. The shaper according to claim 1 in which said means adjacent the upper end of the standard include a cross pin spanning said upper end, the hooked end of the shank being shaped detachably engaging under said cross pin and being detained relative thereto against inadvertent displacement during the shaping process.

4. The shaper according to claim 2 in which said means adjacent the upper end of the standard include a cross pin spanning said upper end, the hooked end of the shank being shaped detachably engaging under said cross pin and being detained relative thereto against inadvertent displacement during the shaping process.

* * * * *